US010702999B2

(12) United States Patent
Iaccarino et al.

(10) Patent No.: US 10,702,999 B2
(45) Date of Patent: Jul. 7, 2020

(54) COMB ARRANGEMENT, CUTTING HEAD, AND HAIR CUTTING APPLIANCE

(71) Applicant: KONINKLIJKE PHILIPS N.V., Eindhoven (NL)

(72) Inventors: Luca Iaccarino, Groningen (NL); Oege Smedinga, Nij Beets (NL); Everhardus Johannes Hoexum, Groningen (NL); Willem Maat, Rohel (NL); Kin Fatt Phoon, Drachten (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 16/349,678

(22) PCT Filed: Mar. 23, 2018

(86) PCT No.: PCT/EP2018/057409
§ 371 (c)(1),
(2) Date: May 14, 2019

(87) PCT Pub. No.: WO2018/177912
PCT Pub. Date: Oct. 4, 2018

(65) Prior Publication Data

US 2020/0009752 A1 Jan. 9, 2020

(30) Foreign Application Priority Data

Mar. 28, 2017 (EP) ..... 17163199

(51) Int. Cl.
*B26B 19/20* (2006.01)
*B26B 19/06* (2006.01)
*B26B 19/38* (2006.01)

(52) U.S. Cl.
CPC ..... *B26B 19/20* (2013.01); *B26B 19/063* (2013.01); *B26B 19/3853* (2013.01)

(58) Field of Classification Search
CPC ... B29B 19/20; B29B 16/063; B29B 19/3853; B29B 19/3813; B29B 19/3806; B29B 19/00; B29B 19/12; B29B 19/3826
(Continued)

(56) References Cited

U.S. PATENT DOCUMENTS 2,577,357 A * 12/1951 Pasquest ..... B26B 19/20 30/201
2,617,188 A * 11/1952 Giorgi ..... B26B 19/20 30/201
(Continued)

FOREIGN PATENT DOCUMENTS

DE 446264 6/1927
EP 0278759 8/1988
(Continued)

OTHER PUBLICATIONS

International Search Report and Written Opinion dated Jun. 14, 2018, for International Application No. PCT/EP2018/057409 filed Mar. 23, 2018.
(Continued)

*Primary Examiner* — Phong H Nguyen

(57) ABSTRACT

A spacing comb arrangement for a hair cutting appliance includes a comb piece configured to be disposed at a skin-facing side of a stationary blade of a blade set. The comb piece has a plurality of comb teeth that define a cutting length of the blade set when the comb arrangement is mounted thereto. The comb piece further has a flexure section configured to urge a frontal portion of the comb piece against the skin-facing side of the stationary blade.

18 Claims, 7 Drawing Sheets

(58) Field of Classification Search
USPC ..... 30/233.5, 194, 233, 241, 200, 201, 195, 30/30, 286
See application file for complete search history.

(56) References Cited

U.S. PATENT DOCUMENTS

| | | | | |
|---|---|---|---|---|
| 2,618,060 | A * | 11/1952 | Giorgi | B26B 19/20 30/201 |
| 2,639,503 | A * | 5/1953 | Thurston | B26B 19/20 30/200 |
| 2,780,868 | A * | 2/1957 | Brown | B26B 19/20 30/200 |
| 2,974,412 | A | 3/1961 | Clark | |
| 3,149,418 | A | 9/1964 | Milbourne | |
| 5,909,929 | A | 6/1999 | Chen | |
| 6,968,623 | B2 | 11/2005 | Braun | |
| 7,637,028 | B2 * | 12/2009 | Allen | B25H 7/00 33/563 |
| 2002/0092177 | A1 | 7/2002 | Eich | |
| 2008/0134516 | A1 | 6/2008 | Morisugi | |
| 2011/0214290 | A1 | 9/2011 | Micinilio | |
| 2019/0009418 | A1 | 1/2019 | Baltussen | |

FOREIGN PATENT DOCUMENTS

| | | |
|---|---|---|
| EP | 2105267 | 9/2009 |
| EP | 2500153 | 9/2012 |

OTHER PUBLICATIONS

International Preliminary Report on Patentability dated Feb. 22, 2019, for International Application No. PCT/EP2018/057409 filed Mar. 23, 2018.

* cited by examiner

COMB ARRANGEMENT, CUTTING HEAD, AND HAIR CUTTING APPLIANCE

CROSS REFERENCE TO RELATED APPLICATIONS

This application is the U.S. National Phase application under 35 U.S.C. § 371 of International Application No. PCT/EP2018/057409 filed Mar. 23, 2018, published as WO 2018/177912 on Oct. 4, 2018, which claims the benefit of European Patent Application Number 17163199.7 filed Mar. 28, 2017. These applications are hereby incorporated by reference herein.

FIELD OF THE INVENTION

The present disclosure relates to a spacing comb arrangement for a hair cutting appliance. The present disclosure further relates to a cutting head for a haircutting appliance that is provided with a respective spacing comb arrangement, and to a respectively equipped hair cutting appliance.

BACKGROUND OF THE INVENTION

U.S. Pat. No. 2,974,412 A discloses an attachment comb unit for an electric hair clipper, the comb unit comprising a plastic comb forming comb teeth, and a sheet metal back portion that is resiliently clamped against a channel-shaped sheet metal support element that is fixedly attached to a stationary blade of the hair clipper. The plastic comb and the sheet metal back portion are slidably mounted to the sheet metal support element by means of a clamping screw that engages a slot at the sheet metal back portion.

DE 446 264 C discloses a hair clipper having a blade set and an adjustable comb for changing the cutting height during cutting, wherein the comb is movable with respect to the blade set, wherein the comb is pivotably attached to a push piece, and wherein a leaf spring is provided between the push piece and the comb that urges the comb against the blade set.

EP 2 105 267 A1 discloses a hair clipper comprising a main body portion, a comb-shaped blade unit having a pair of blades comprising a movable blade and a stationary blade, and a spacing comb having a comb portion associated with the stationary blade, wherein the comb portion is pivotable between an engagement state and an out-of-engagement state.

Hair cutting appliances, particularly electric hair cutting appliances, are generally known and may include trimmers, clippers and shavers. Electric hair cutting appliances may also be referred to as electrically powered hair cutting appliances. Electric hair cutting appliances may be powered by electric supply mains and/or by energy storages, such as batteries, for instance. Electric hair cutting appliances are generally used to trim or remove (human) body hair, in particular facial hair and head hair to allow a person to have a well-groomed appearance. Frequently, electric hair cutting appliances are used for cutting animal hair.

U.S. Pat. No. 6,968,623 B2 discloses a hair trimmer comprising a body, a cutting head including a blade set, an adjustable comb, wherein the comb is movable with respect to the blade set, an electric motor for driving the blade set to effect a cutting action, and an actuator assembly that is capable of moving the comb with respect to the blade set between a fully retracted position and a fully extended position, the actuator assembly comprising a comb carriage, a comb button connected to the comb carriage, wherein the comb button is actuatable to adjust the position of the comb relative to the blade set, and a lock button movable with respect to the comb button, wherein the lock button selectively prevents and permits movement of the comb button relative to the body. Consequently, manual adjustment of the length of the comb is enabled.

A comb for a hair cutting appliance, particularly a spacing comb, generally may be arranged as an attachable comb or an integrally formed comb. A spacing comb generally spaces a blade set of the hair cutting appliance away from the skin when the appliance is moved in a moving direction with respect to the skin during operation. Consequently, the spacing comb may enable to process/cut hair to a desired length, i.e. to a desired length of remaining hair at the skin.

Conventional hair cutting appliances may be fitted with a set of attachment combs, each of which associated with a distinct hair length. Consequently, a user of the appliance basically needs to replace an attachment comb by another one to change the hair cutting length. Furthermore, manually adjustable comb attachments are known, as disclosed in U.S. Pat. No. 6,968,623 B2. Furthermore, also powered adjustment combs have been presented in recent years, as for instance disclosed in EP 2 500 153 A2. Typically, powered adjustment combs comprise a movable comb portion that is movable with respect to a blade set of the hair cutting appliance, wherein the movable comb portion is coupled to an actuator, particularly to an electromotor and/or an electric powertrain.

Using spacing combs has the benefit that an even hair length may be achieved, for instance a length of 3.0 mm, 6.0 mm, 9.0 mm, etc. Hence, particular short haircuts, three-day beards and similar procedures may be simplified.

Generally, as shown in U.S. Pat. No. 6,968,623 B2 and in EP 2 500 153 A2, a spacing comb, particularly an adjustable spacing comb, is attached to a cutting head of a hair cutting appliance in such a way that a frontal portion of the teeth of the comb extends beyond, or even covers, the tips of the blade set of the hair cutting appliance, as seen in a frontal direction that is basically aligned with a movement direction of the appliance along the skin. In this way, on the one hand, a considerable hair catching capacity of the combined blade set with the attachment comb is ensured. This involves that the comb teeth are arranged to lift the hair when the appliance to which the comb is attached is moved through the haired portion. However, on the other hand, this involves that even in a retracted state of the adjustment comb, the tips of the teeth thereof protrude beyond the tips of the stationary blade. Further, in some embodiments, the teeth of the comb are provided with a locking recess which may be engaged by the teeth of the stationary blade of the blade set. Hence, the attachment comb is also properly fixed to the toothed portion of the blade set in a positive fit fashion.

A further goal of the embracing design of the teeth of the attachment comb is to prevent hairs from entering a gap between the teeth of the stationary blade and the teeth of the attachment comb, and being trapped or being jammed in the gap. This would actually result in hairs becoming ripped out.

However, the above arrangement has some drawbacks. First, even in a fully retracted state, at least the tips of the teeth of the attachment comb protrude beyond the teeth of the blade set. This somewhat obstructs the cutting zone. Hence, trimming and styling operations are somewhat complicated due to impaired visibility conditions. Further, as the attachment comb somewhat blocks and covers the frontal end of the blade set, the reachability of the appliance is deteriorated. This appears, for instance, when a mustache on the upper lip is trimmed and styled. It is then often difficult, if not impossible, to reach the transitional edge between the upper lip and the nose with the teeth of the blade set. In practice, this often involves that the uppermost hairs that are very close to the nose cannot be adequately trimmed to the desired length. Similar problems may occur when sideburns are processed, when head hair in the vicinity of the ears is processed, and/or when sharp edges between shaved and non-shaved portions are processed and groomed.

There is thus still room for improvement in spacing comb arrangements and, more generally, length adjustment mechanism for hair cutting appliances.

SUMMARY OF THE INVENTION

In view of the above, it is an object of the present disclosure to seek for a spacing comb arrangement that tackles at least some of the above-indicated issues. In particular, it is desirable to present a spacing comb arrangement having a comb piece that is arranged to cling to the blade set, particularly to the stationary blade thereof, regardless of an actual adjustment position of the comb piece. Further, it is desirable to present a spacing comb arrangement having a comb piece that improves the general reachability behavior of the hair cutting appliance. Further, it is desirable to present a spacing comb arrangement having a comb piece that is nevertheless configured to reduce or even avoid a jamming or clamping of hairs between the stationary blade and the comb piece. Further, it is desirable to present a spacing comb arrangement involving a comb piece that is arranged to be coupled to a blade set of a hair cutting appliance, wherein the comb arrangement has a considerable hair catching and hair lifting capacity.

Further, it is desirable to present a spacing comb arrangement that is adjustable so that a defined set of cutting lengths is provided. Further, it is desirable to present a spacing comb arrangement comprising a comb piece that is easy to manufacture and easy to operate.

It is also desirable to provide a cutting head for a hair cutting appliance that is arranged to be coupled to and/or provided with a comb arrangement having a comb piece. Further, it is an object of the present disclosure to provide a corresponding hair cutting appliance that is equipped with or provided with a respective comb arrangement.

In a first aspect of the present disclosure a spacing comb arrangement for a hair cutting appliance is presented, the comb arrangement comprising a comb piece that is arranged to be disposed at a skin-facing side of a stationary blade of a blade set, the comb piece comprising:

- a plurality of comb teeth that define a cutting length of the blade set when the comb arrangement is mounted thereto, and
- a frontal portion, a rear portion arranged to be attached to the hair cutting appliance, and a flexure section arranged therebetween that is arranged to urge the frontal portion against the skin-facing side of the stationary blade, when the appliance is operated,
- wherein the flexure section defines a deflection axis between the frontal portion and the rear portion,
- wherein the flexure section is integrated in the comb piece, and
- wherein a directional bias on the frontal portion is present when the comb piece is attached to the hair cutting appliance.

This aspect is based on the insight that the comb piece may be formed in such a way that a directional bias or preloading is present when the comb piece is attached to the hair cutting appliance. Hence, it is ensured that the frontal portion of the comb piece is at least slightly pressed against the skin facing side of the stationary blade of the blade set. Hence, a tight frontal contact zone between the comb piece and the stationary blade is provided. This measure has the benefit that it is not necessary to design the comb piece in such a way that even in a fully retracted state thereof the tips of the teeth of the comb piece in a frontal direction have to protrude beyond the tips of the teeth of the stationary blade.

By way of example, the fully retracted position of the comb piece may correspond to a cutting length of 1.0 mm, 1.5 mm, or 2.0 mm, which, however, shall not be interpreted in a limiting sense. In existing comb arrangements, even in a fully retracted state that involves comparable cutting lengths, the teeth of the comb piece overlap or even embrace the tips of the teeth of the stationary blade at a frontal end thereof. Hence, compared to conventional comb arrangements, a greater visibility and reachability is provided.

In an exemplary embodiment of the comb arrangement, the flexure section provides the comb piece with an increased deformability for the movement of the frontal portion.

This embodiment is based on the insight that the comb piece may be formed in such a way that a sufficient level of flexibility is provided so that the frontal portion may be brought into contact with the stationary blade, particularly the teeth thereof. The deformation may be caused by an inherent biasing force that is present in the comb piece, or by an external force applied by a user of the appliance. It is to be noted that this embodiment may form a beneficial refinement of the above introduced first aspect, or may be regarded as a separate aspect that may be pursued in isolation.

Further, as the comb arrangement is, in at least some embodiments, adjustable, it can be ensured that in each adjustment position a certain preloading and therefore a close contact between the comb piece and the stationary blade, in the respective frontal portions thereof, is provided. This has the effect that any gap between the frontal ends of the stationary blade and the comb piece may be reduced or even avoided. In this way, hairs may be prevented from entering a gap between the stationary blade and the comb piece, and from being clamped and jammed therein. Hence, the trimming comfort may be improved. Skin irritations and ripping hairs off from the skin may be reduced or even avoided.

The comb piece may be arranged as a releasably attachable comb piece. However, in some embodiments, the adjustable comb piece may form a non-releasable component of the hair cutting appliance. In some embodiments, the comb piece is arranged for length adjustment. As used herein, length adjustment relates to hair length adjustment. Typically, an adjustable comb defines an offset between a cutting portion or blade set and a skin portion which results in a corresponding remaining hair length after the hair cutting or trimming operation.

While main aspects of the present disclosure are presented and discussed herein in connection with a mechanical, manually operated length adjustment mechanism, this shall not be interpreted in a limiting sense. Rather, also powered length adjustment arrangements may profit from a spacing comb arrangement as presented herein.

As used herein, the skin-facing side of the stationary blade is the side thereof that is facing away from the housing of the hair cutting appliance and that is in contact with the skin when the hair cutting appliance is operated without an attachment comb. In the mounted state, the comb piece is arranged at the stationary blade opposite to a respective movable blade of the blade set. Hence, when the comb piece is attached to the hair cutting appliance, the stationary blade is arranged between the movable blade and the comb piece.

As used herein, the spacing comb arrangement basically involves the comb piece. However, in some embodiments, fasteners, adjustment parts, and further components may form part of the spacing comb arrangement. Generally, the spacing comb arrangement may be arranged as a set or kit that is arranged to be attached to the hair cutting appliance to cooperate with the blade set thereof.

In a further exemplary embodiment of the comb arrangement, when the comb piece is attached to the hair cutting appliance, the frontal portion and the rear portion are twisted or tilted away from one another about an axis defined by the flexure section to generate a respective counterforce that urges the frontal portion against and into contact with the stationary blade.

In another exemplary embodiment, the flexure section is integrated in the comb piece. Generally, the flexure section may be regarded as a joint or hinge formed in the comb piece that defines a bending or deflection axis. The bending axis may be formed as a virtual axis. Generally, the bending axis is parallel to a connecting line between outermost teeth of the stationary blade and/or the comb piece. In this way, a uniform biasing force and impact along the plurality of teeth of the stationary blade that are arranged in a series may be provided.

Generally, at least in some embodiments, the comb piece may comprise, in addition to the frontal portion, a rear portion, wherein the flexure section is arranged therebetween. Hence, at the rear portion, the comb piece may be attached to the hair cutting appliance in such a way that a bias or preloading is generated, due to a defined deformation of the comb piece. Hence, when the comb piece is attached to the appliance, the frontal and the rear portion may be twisted or tilted away from one another about the axis defined by the flexure section. This results in a respective counterforce that urges the frontal portion against the stationary blade.

In another exemplar embodiment of the comb arrangement, at least one living hinge is formed between the frontal portion and a rear portion of the comb piece. Hence, no discrete, separately formed pivot axis or hinge is to be provided. A living hinge is sufficiently flexible to allow for the desired bending action. By incorporating a living hinge, the comb piece is easy to manufacture and easy to assemble. The living hinge may form the flexure section and define the respective bending axis of the comb piece.

In another exemplary arrangement, the comb arrangement is adjustable, wherein the comb piece is movable with respect to the stationary blade between a retracted state and an extended state. The retracted state corresponds to a considerably small cutting length. The extended state corresponds to a considerably great cutting length. The adjustment action may involve a gradual adjustment or incremental adjustment. In the alternative, the adjustment action may involve a stepless or continuous adjustment. In either case, the comb piece may be moved with respect to the stationary blade in a sliding movement. As the frontal portion of the comb piece is, in a lateral view, preferably tapered towards the tips of the comb teeth, the adjustment movement involves a length adjustment.

As the frontal end of the comb piece protrudes, in the frontal direction, beyond the tips of the stationary blade when the comb piece is moved from the retracted state to the extended state, the biasing or bending force that is present, or, at least, generated, ensures that there is still a close contact between the tips of the stationary blade teeth and the frontal portion of the comb piece. In some embodiments, the adjustment movement of the comb piece involves a pivot or swivel movement of the frontal portion with respect to the rear portion of the comb piece. In this way, the comb piece may be adapted to a tapered or tilted design of the teeth of the stationary blade.

In yet another exemplary embodiment, an inherent warpage of the comb piece urges the frontal portion thereof towards the stationary blade. The comb piece may provide, in accordance with this embodiment, an internal preloading that induces the bending action. Further, when the comb piece is manufactured by injection molding, an injection molding mold and/or respective molding parameters may be selected so that the internal tension is generated when the comb piece is manufactured.

In still another exemplary embodiment, the comb piece is shaped in such a way that the frontal portion thereof is urged against the stationary blade when a rear portion thereof is mounted to the appliance. Hence, the comb piece may be distorted by the assembly operation. Therefore, even if in an unassembled state no internal preloading is present, the bending force may be provided in the attached state.

In yet another exemplary embodiment of the comb arrangement, when the comb piece is moved with respect to the stationary blade in an adjustment movement direction, the rear portion assumes and maintains a parallel orientation and close contact with the stationary blade, particularly with the basically planar rear portion at the skin-facing side thereof. Hence, when the comb piece is moved (adjusted) in this way, the frontal portion is pivoted with respect to the rear portion about the flexure section that forms a pivot axis.

In yet another exemplary embodiment, separate biasing elements may be provided that are arranged to urge the frontal portion of the comb piece against the stationary blade. To this end, metal springs, plastic springs and such like may be used.

Further, the biasing force may be generated, at least in part, by an external press-on force applied by the user when the comb piece contacts the skin.

In still a further exemplary embodiment of the comb arrangement, the comb piece is integrally shaped. In other words, the comb piece is formed in one piece. Arranging the comb piece to be shaped in only one piece greatly simplifies the manufacture thereof. One and the same integral part may be provided with the frontal portion, the rear portion, and the flexure section formed therebetween. Nevertheless, a more than just microscopic bending action may be provided, for instance by integrating a living hinge and/or using internal tension.

In still a further exemplary embodiment of the comb arrangement, the comb piece is a multi-component integrally formed part, wherein a soft component and at least one hard component are provided that are bonded to one another.

In one embodiment, the comb piece is a multi-component injection molding part. By way of example, two hard components may be provided, one of which is the frontal portion, and the other one is the rear portion. Hence, the biasing section or flexure section may be formed by a soft component that is formed between the two hard components. The soft component may in this way define the bending/deflection axis. Multi-component injection molding is, as such, generally known in the art.

Further, in an alternative embodiment, multi-component injection molding may be used to form a comb piece that basically comprises two sections that are movable with respect to one another. This may involve an in-mold assembling. In this way, discrete hinges or joints may be formed.

In another embodiment, the comb piece may be arranged as an overmolded or insert molded part, wherein a metal component and at least one plastic component are provided and bonded to one another. The metal component may form an insert that is at least partially overmolded by the plastic component. Hence, the metal component may act as a biasing element that generates a biasing force that urges the frontal portion of the comb piece against the skin-facing side of the stationary blade.

In still a further exemplary embodiment of the comb arrangement, an indentation is formed in the comb piece that increases the flexibility of the comb piece. The indentation is laterally extending through the comb piece. Hence, seen in a lateral view, a respective cross-section of the comb piece involves a significantly reduced wall thickness in the flexure section. In some embodiments, the indentation is formed at a side of the comb piece that is facing the stationary blade. Hence, in this embodiment, on a skin-facing side of the comb piece the indentation is not present.

In yet another exemplary embodiment of the comb arrangement, the indentation is groove shaped and provided with a frontal flank, a rear flank, and groove base formed therebetween, wherein the frontal flank and the rear flank form a limit stop for a bending movement between the frontal portion and the rear portion of the comb piece. Hence, the indentation does not only increase the flexibility of the comb piece but also defines a maximum bending movement.

In yet another exemplary embodiment of the comb arrangement, at the frontal portion of the comb piece, at least one depression is provided, the depression extending parallel to a leading edge of the stationary blade, wherein frontal tips of the stationary blade at least partially dip in the depression when the comb piece and the stationary blade are in a defined relative longitudinal position.

In yet another exemplary embodiment of the comb arrangement, at the frontal portion of the comb piece at least one depression is provided, the depression extending parallel to a leading edge of the stationary blade and arranged to be engaged by frontal tips of stationary blade teeth when the comb piece and the stationary blade are in a defined relative longitudinal position.

As used herein, the leading edge of the stationary blade is defined by a connection line connecting the tips of at least the outermost teeth, preferably of all the teeth of the stationary blade. Hence, the leading edge is basically perpendicular to an assumed moving direction of the appliance when performing a hair cutting procedure.

Generally, the defined relative longitudinal position corresponds to a defined cutting length. Needless to say, the at least one depression is formed in the teeth of the comb piece. Hence, the depression may involve respective recesses in the teeth of the comb piece that are formed in the side thereof that is facing the stationary blade.

In yet another exemplary embodiment, a plurality of depressions is provided that are basically parallel to one another, wherein the arrangement of the depressions is adapted to respective length adjustment positions of the comb piece in relation to the stationary blade. Hence, assuming that a graduated or stepped adjustment of the cutting length is possible, the respective depressions may assume a longitudinal position that is adapted to the relative longitudinal position between the comb piece and the stationary blade.

As the tips of the stationary blade may at least partially dip in the depressions, the frontal section of the comb piece may be tilted even further towards the stationary blade. This has the effect that, at least in a considerably extended state of the comb piece with respect to the stationary blade, the teeth of the comb piece may at least partially cover the tips of the teeth of the stationary blade. This further improves the hair catching and hair lifting performance of the hair cutting appliance.

The above described embodiments relating to the provision of indentations or depressions at the comb teeth that are arranged to be engaged by the tips of the stationary blade teeth are applicable to either aspect of the comb piece described herein. Hence, the dipping feature may be implemented in the context of the aspect relating to an inherent biasing feature that urges the frontal portion of the comb piece against the stationary blade. Further, the dipping feature may be implemented in the context of the aspect relating to the flexure section that may be deformed, at least in part, due to external forces applied to the appliance to move the frontal portion towards the stationary blade.

In a further aspect of the present disclosure there is presented a cutting head for a hair cutting appliance, the cutting head comprising a blade set including a movable blade and a stationary blade that are arranged to be moved with respect to one another to cut hair trapped therebetween, wherein the cutting head comprises a comb arrangement in accordance with at least one embodiment as described herein.

As used herein, the terms movable blade and stationary blade are used to describe the two basic components of a blade set. As used herein, the stationary blade shall be regarded as the blade that is basically fixedly attached to a housing of the hair cutting appliance. By contrast, as used herein, the movable blade shall be regarded as the blade of the blade set that is movably received at the housing to be moved with respect to the stationary blade. Hence, a motor powered drive of the hair cutting appliance is operatively coupled to the movable blade to move the movable blade with respect to the stationary blade.

In a further exemplary embodiment of the cutting head, the comb piece is arranged to be moved between an extended position and a retracted position. Generally, the extended position corresponds to a large cutting length. Similarly, the retracted position corresponds to a short cutting length.

Further, in yet another exemplary embodiment, in the retracted position, the comb piece does not protrude, in the frontal direction, beyond a frontal end of the stationary blade. Further, in certain embodiments, the stationary blade, in the retracted position of the comb piece, protrudes beyond a frontal end in the frontal direction.

In yet another exemplary embodiment, in the retracted position of the comb piece, tips of the stationary blade and the comb piece are basically aligned in the frontal direction when the comb piece is in the retracted position. Hence, the tips of the stationary blade and the tips of the comb piece, in this position, end on the same or basically the same level in the frontal direction.

In a further exemplary embodiment of the cutting head, the stationary blade comprises, at a skin-facing side thereof, a basically planar rear portion and an inclined frontal portion, wherein the frontal portion of the comp piece is urged against the frontal portion of the stationary blade. As indicated further above, also the teeth of the stationary blade may involve a tapered design including a reduced thickness from a rear end to the frontal tips thereof. To achieve the desired tapered design, an inclined portion may be formed at the skin-facing side of the stationary blade. Hence, it is beneficial to make the comb piece sufficiently flexible to adapt the comb piece, particularly the frontal portion thereof, to the inclined frontal portion of the stationary blade.

In yet another aspect of the present disclosure there is presented a hair cutting appliance, particularly an electrically powered hair trimmer, the appliance being arranged to be moved through hair to cut hair and comprising a housing, a cutting head, and a comb arrangement in accordance with at least one embodiment as discussed herein. The comb arrangement may be configured to be attached to the cutting head. Preferably, the comb arrangement is an adjustable comb arrangement enabling a cutting length adjustment. Further, the comb arrangement is preferably removably attachable. Hence, the hair cutting appliance may be operated without any comb arrangement attached thereto and in a state equipped with the comb arrangement.

BRIEF DESCRIPTION OF THE DRAWINGS

These and other aspects of the disclosure will be apparent from and elucidated with reference to the embodiments described hereinafter. In the following drawings

DETAILED DESCRIPTION OF THE INVENTION

Figure 1:
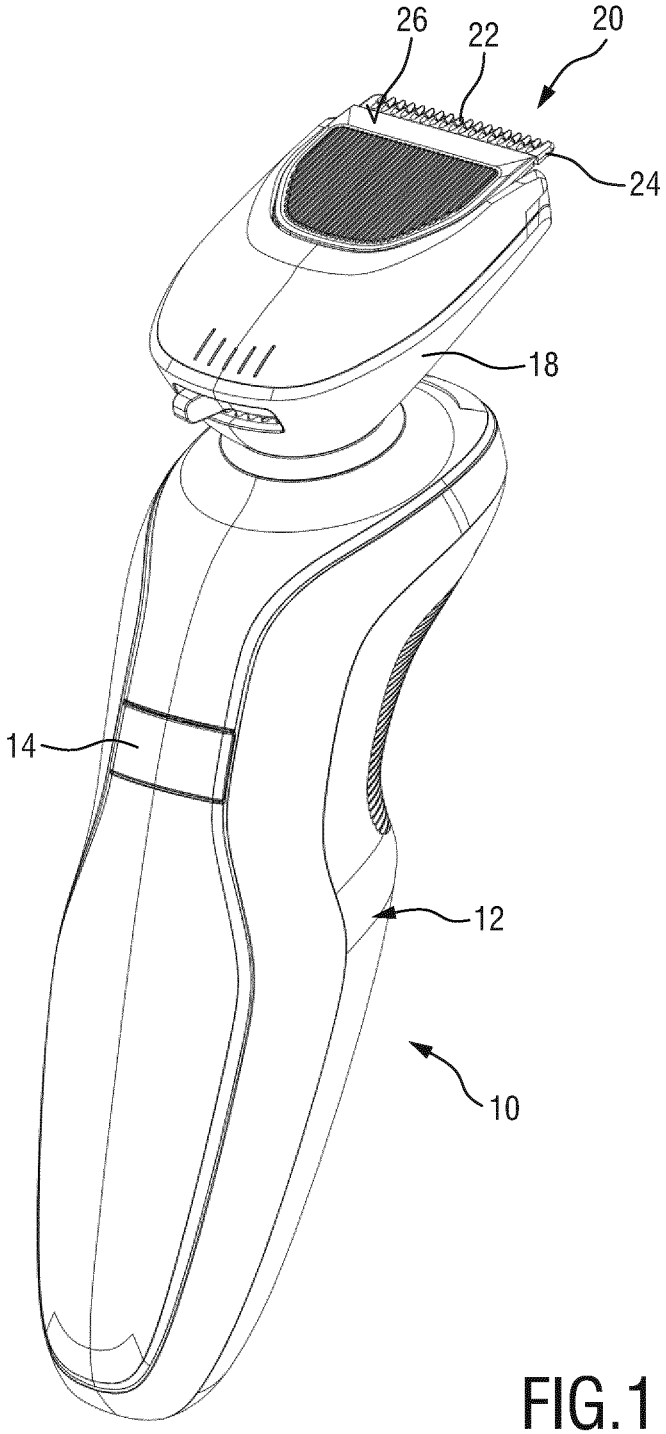
FIG. 1 shows a perspective rear view of a hair cutting appliance to which a spacing comb (not shown in FIG. 1) may be attached.

FIG. 1 shows a hair cutting appliance 10. Conventional hair cutting appliances as such are widely known and described in the art.

The hair cutting appliance 10 comprises a housing 12 and operating controls 14, for instance an ON/OFF bottom. The housing 12 may accommodate a motor, a battery (if any), a power supply (if any), a control unit, and a drive train or drive mechanism. Generally, the housing 12 of the hair cutting appliance 10 has an elongated shape having a first end and a second end. The first end may be also referred to as cutting head end. At the first end of the housing 12, a cutting head 18 is provided. At the cutting head 18, a blade set 20 is arranged. As shown in the exemplary embodiment of FIG. 1, the cutting head 18 is arranged in a somewhat exposed and elevated fashion. Consequently, a cutting head housing is provided which may be referred to as a portion of the overall housing 12.

In accordance with the exemplary embodiment of FIG. 1, the cutting head 18 is arranged in a pod-like fashion. The pod-like shape of the cutting head 18 has the advantage that the cutting head 18 is elevated, and may be rotated with respect to the (main) housing 12 of the appliance 10. This may facilitate shaving or trimming hair at hard-to-reach areas. However, this requires that internal components of the appliance 10 are arranged to accommodate and/or enable the relative rotation between the (main) housing 12 and the cutting head 18.

The arrangement of the hair cutting appliance 10 of FIG. 1 has the advantage that the cutting head 18 may be separated from a main portion of the appliance 10. For instance, in exemplary embodiments, different cutting heads 18 may be provided, such as a (foil) shaving head, a trimming head, a styling head, etc. The cutting head 18 as exemplarily shown in FIG. 1 is particularly suited for trimming operations.

However, in alternative embodiments, the cutting head 18 may form a more integrated component of the appliance 10, wherein particularly a housing of the cutting head 18 is arranged as an integral portion of the (overall) housing 12. Therefore, as used herein, the housing of the cutting head 18 shall not be regarded as a necessarily distinct housing. Rather, the housing of the cutting head 18 may be arranged as a distinct, elevated housing or as an integrated housing portion of the overall housing portion 12.

Consequently, whenever reference is made herein to the cutting head housing, this may refer as well to the overall housing 12 of the appliance 10, where applicable.

As shown in more detail further below, the blade set 20 typically comprises a stationary blade 22 and a movable blade 24. In FIG. 1, the movable blade 24 is covered by the stationary blade 22 that is arranged on top thereof. The stationary blade 22 may also be referred to as guard or guard blade. The movable blade 24 may also be referred to as cutter or cutter blade. At a top end of the cutting head 18, a skin-facing side of the stationary blade 22 is indicated by 26.

In case it is desired to have a haircut or beard of a defined cutting length (e.g. of 3.0 mm, 6.0 mm, 9.0 mm, etc.) so-called spacing combs may be attached to the appliance 10.

Figure 2:
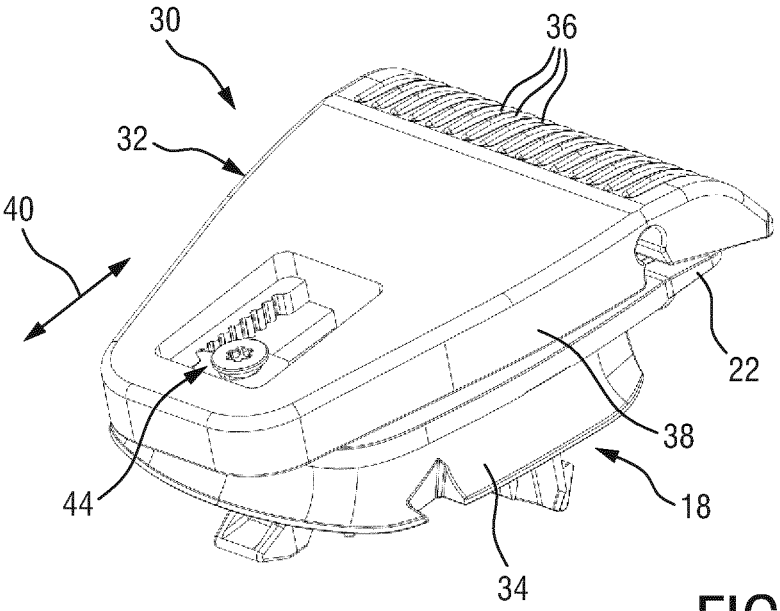
FIG. 2 shows a perspective rear view of an embodiment of a cutting head for a hair cutting appliance to which a comb arrangement is attached.
Figure 3:
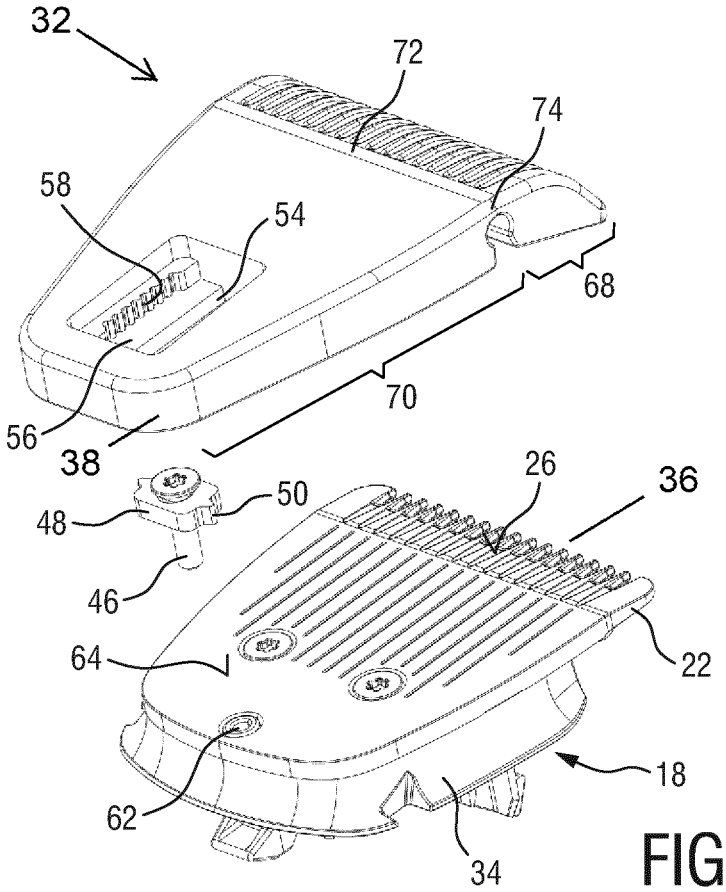
FIG. 3 shows the arrangement illustrated in FIG. 2 in a state where a comb piece of the comb arrangement is detached from the cutting head.
Figure 4:
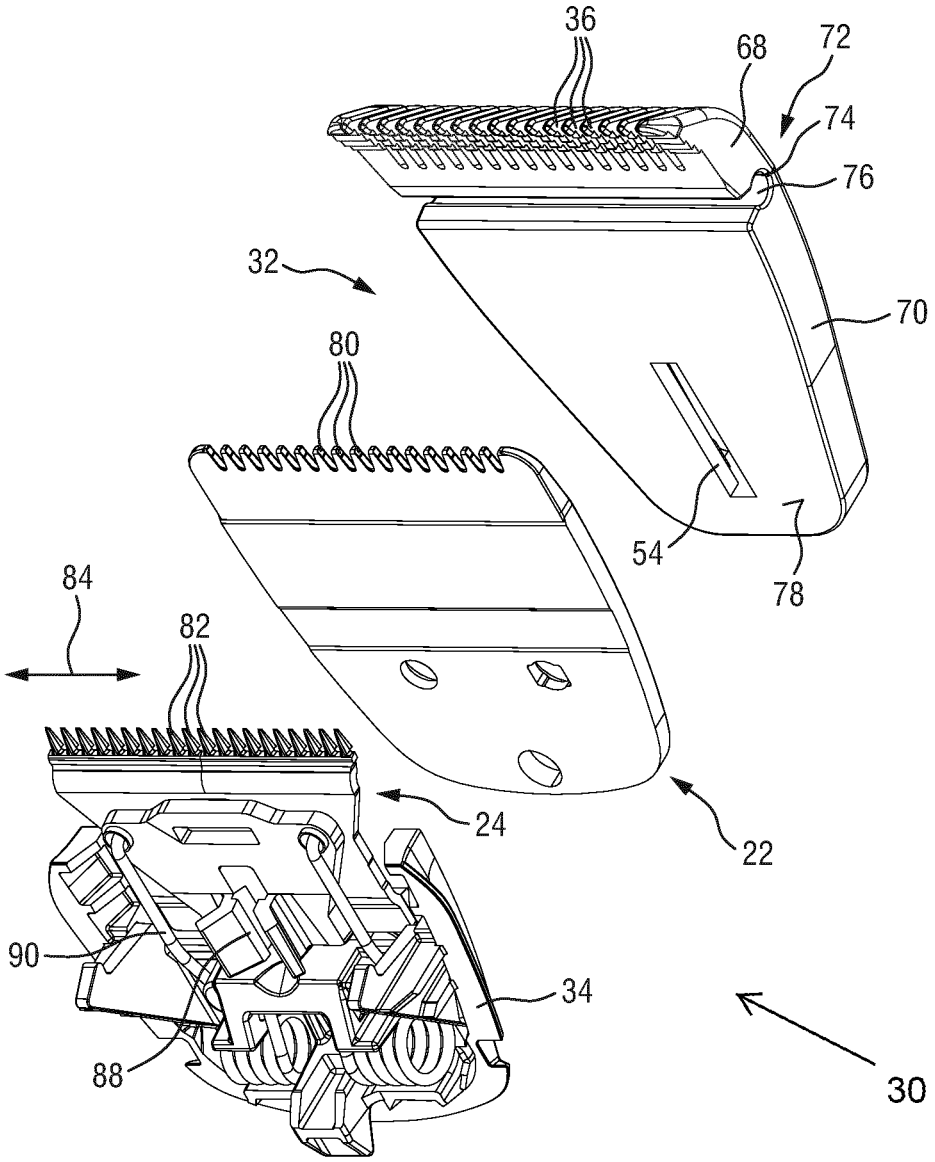
FIG. 4 is a perspective frontal view of the arrangement shown in FIG. 2 and FIG. 3, wherein the stationary blade and the comb piece are shown in an exploded state.

Reference is made to FIG. 2, FIG. 3 and to FIG. 4 that exemplify an embodiment of a spacing comb arrangement 30 that is arranged to be attached to a hair cutting appliance 10 as shown in FIG. 1, for instance. More particularly, the spacing comb arrangement 30 is arranged to be coupled to the cutting head 18 of the appliance 10. The spacing comb arrangement 30 may be configured to be attached to the appliance 10 in a releasable fashion.

The spacing comb arrangement 30 is shown in FIG. 2 in an attached state. In FIG. 3, the spacing comb arrangement 30 is shown in a state detached from a cutting head 18 and a blade set 20, respectively. In FIG. 4, primarily for illustrated purposes, an exploded view is provided wherein the stationary blade 22 and the spacing comb arrangement 30 (particularly a comb piece 32 thereof) are shown in a detached state.

The spacing comb arrangement 30 comprises a comb piece 32 that is placed on a skin-facing top end of the stationary blade 22 of the blade set 20. To this end, a mounting section 34 is provided which may form part of the housing of the cutting head 18 and/or, more generally, the housing 12 of the hair cutting appliance 10 (refer to FIG. 1).

The comb piece 32 is provided with a series of comb teeth 36 that are, in the mounted state, aligned with respective teeth of the blade set 20. The comb teeth 36 are formed at and define a frontal portion of the comb piece 32.

As illustrated in FIG. 2 and FIG. 3, the comb piece 32 may further involve a mounting plate 38 formed at a rear section thereof. The mounting plate 38 is a generally rigid and stiff portion of the comb piece 32.

In FIG. 2, a double arrow 40 indicates a movement direction or adjustment direction for the comb piece 32 with respect to the blade set 20, particularly the stationary blade 22 thereof. The movement direction 40 is generally parallel to a common contact surface between the comb piece 32 and the stationary blade 22. The contact surface is formed at a skin-facing side of the stationary blade 22 and a side of the comb piece 32 that is facing away from the skin.

To effect the adjustment of the spacing comb arrangement 30, a locking and adjustment mechanism 44 is provided. The mechanism 44 comprises a fastener 46 that is arranged to attach the comb piece 32 to the cutting head 18 of the appliance 10. The mechanism 44 further comprises a retaining element 48 that is provided with lateral protrusions 50. In the mounted state as indicated in FIG. 2, the fastener 46 extends through the retaining element 48 as shown in FIG. 3. The fastener 46 pushes the retaining element 48, in the mounted state, against a retaining tab 56 that is formed in a guiding slot 54 in a rear area of the comb piece 32. In the slot 54, further indexing positioning recesses 58 are provided that are arranged to cooperate with the engagement protrusions 50 of the retaining element 48. In this way, as a plurality of positioning recesses 58 are formed, a respective number of relative adjustment positions between the comb piece 32 and the stationary blade 22 may be provided.

In FIG. 3, a screw hole 62 is illustrated that is arranged to be engaged, in the mounted state, by the fastener 46 that may be arranged as a screw, for instance. This screw hole 62 is arranged in a rear portion of the stationary blade 22. In FIG. 3, there is further indicated a sliding plane 64 at the (skin-facing) top side of the stationary blade 22. When the comb piece 32 is moved in the movement direction 40 (FIG. 2), this involves a sliding movement along the sliding plane 64.

At the comb piece 32, a contact surface 78 (FIG. 4) is formed that is arranged to contact the sliding plane 64 and to be moved along the sliding plane 64 in the movement direction 40 for length adjustment.

It should be noted that further alternative embodiments of adjustment mechanisms are conceivable. Hence, the locking and adjustment mechanism 44 exemplarily illustrated in FIG. 2 and FIG. 3 is primarily shown for illustrative purposes, and not to limit the scope of the disclosure.

As shown in FIG. 3, the comb piece 32 comprises a frontal portion 68 and a rear portion 70. At the frontal portion 68, the teeth 36 of the comb piece 32 are formed. At the rear portion 70, the mounting plate 38 is formed. Further, the guiding slot 54 is formed at the rear portion 70. Between the frontal portion 68 and the rear portion 70, a biasing section or flexure section 72 is formed. The flexure section 72 connects the frontal portion 68 and the rear portion 70 and forms a transition zone therebetween.

In the exemplary embodiment illustrated in FIG. 2, FIG. 3, and FIG. 4, a living hinge 74 forms the flexure section 72. The living hinge 74 comprises a greatly reduced wall thickness, compared to the frontal portion 68 and the rear portion 70. Hence, in the flexure section 72, an indentation 76 is formed extending laterally through the comb piece 32. The indentation 76 is formed at the side of the comb piece 32 that contacts the stationary blade 22. A general goal of this design is to form a flexible zone and to generate a bias or tensioning force that urges the frontal portion 68 against the stationary blade 22 when the comb piece 32 is attached to the appliance 10. In this way, the comb teeth 36 are at least slightly pressed against teeth 80 of the stationary blade.

At the movable blade 24 of the blade set 20, respective teeth 82 are provided. A reciprocating cutting movement between the stationary blade 22 and the movable blade 24 is indicated in FIG. 4 by 84. In FIG. 4, there is further shown a driving engagement slot 88 that may be engaged by a revolving driving pin to convert a basically rotational driving movement to the reciprocating cutting movement 84. Further, a guide mechanism 90 is provided by which the movable blade 24 is movably attached to and guided with respect to the mounting section 34 or, more generally, the housing 12 of the appliance 10.

It should be noted that the arrangement of the driving mechanism for the blade set 20 illustrated in FIG. 4 is primarily provided for illustrative purposes, and not to limit the scope of the present disclosure.

Figure 5:
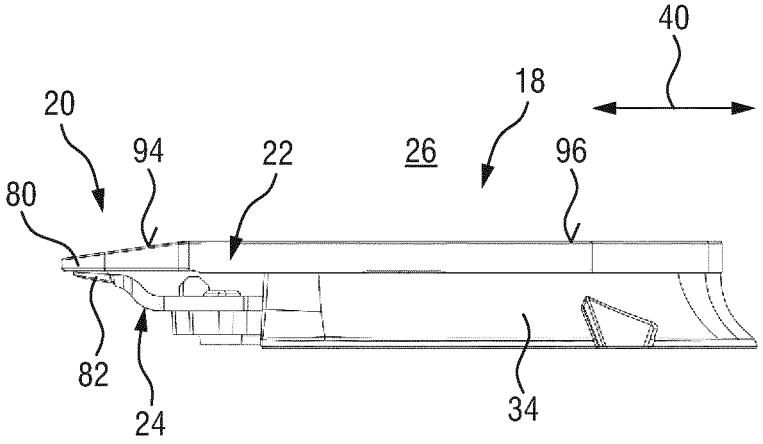
FIG. 5 is a lateral view of an embodiment of a blade set for a cutting head of a hair cutting appliance.
Figure 6:
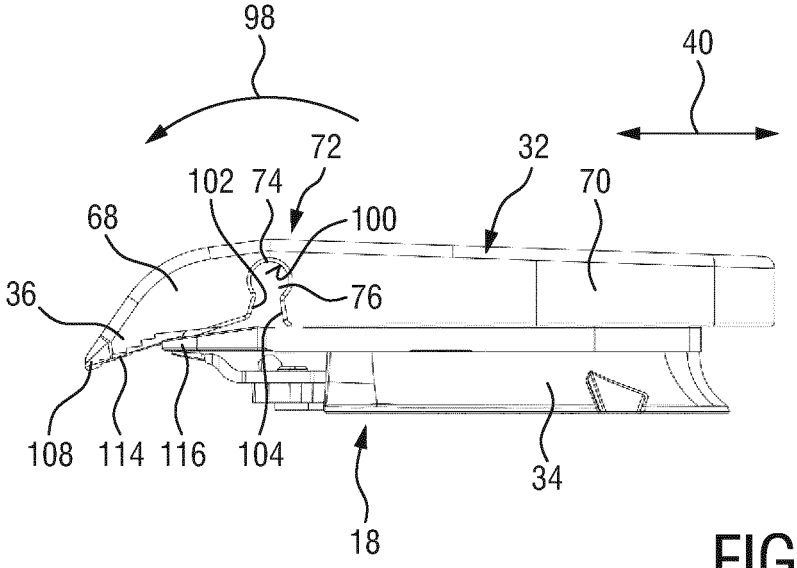
FIG. 6 is a further view of the arrangement shown in FIG. 5, wherein a comb piece is attached to the cutting head.

Further reference is made to FIG. 5 and FIG. 6. Therein, a lateral view of the cutting head 18 is provided. In FIG. 6, the comb piece 32 is attached to the cutting head 18. In FIG. 5, no comb piece 32 is present. The lateral view plane of FIG. 5 and FIG. 6 is basically perpendicular to the movement direction 84 indicated in FIG. 4. Further, the adjustment movement direction 40 is parallel to the view plane of FIG. 5 and FIG. 6.

The stationary blade 22 shown in FIG. 5 and FIG. 6 comprises, at the skin-facing side 26 thereof, an inclined frontal portion 94 and a basically planar rear portion 96. Hence, in lateral view, the teeth 80 of the stationary blade 22 are tapered. This has the effect that in the configuration shown in FIG. 5, hairs can be cut very close to the skin which facilitates shaving and styling operations. In the state in FIG. 6 where the cutting head 18 is equipped with the comb piece 32, the teeth 36 at the frontal portion 68 of the comb piece 32 define a resulting cutting length as they space the teeth 80 of the stationary blade 22 away from the skin.

The resulting cutting length is defined by adjusting the relative position between the comb piece 32 and the stationary blade 22 in the adjustment movement direction 40. As already indicated before, in addition to the frontal portion 68, the comb piece 32 is provided with a rear portion 70 and a flexure section 72 formed therebetween. At the flexure section 72, a living hinge 74 is provided. Due to the design of the comb piece 32, a bending force is induced, as indicated by a curved arrow 98 in FIG. 6. The bending bias 98 urges the frontal portion 68 of the comb piece 32 against the stationary blade 22, particularly against the teeth 80 thereof.

In exemplary embodiments, when the comb piece 32 is moved with respect to the stationary blade 22 in the adjustment movement direction 40, the rear portion 70 assumes and maintains a parallel orientation and close contact with the stationary blade 22, particularly with the basically planar rear portion 96 at the skin-facing side 26 thereof. Hence, when the comb piece 32 is moved (adjusted) in this way, the frontal portion 68 is pivoted with respect to the rear portion 70 about the flexure section 72 that forms a pivot axis.

It can be further seen from the lateral view of FIG. 6 that in the embodiment shown therein the indentation 76 is slot-shaped and extends perpendicular to the view plane of FIG. 6. The indentation 76 comprises a groove base 100 that is arranged between a frontal flank 102 and a rear flank 104. The design of the indentation 76, on the one hand, increases the flexibility of the flexure section 72. Further, a maximum pivot movement is defined as the frontal flank 102 and the rear flank 104 may contact and abut one another in a maximally twisted or tilted state of the comb piece 32.

In FIG. 6, there is further indicated a tip 108 of the teeth 36 of the comb piece 32. At the side of the frontal portion 68 that is facing away from the skin, a contact zone 114 is provided that is contacted or engaged by tips 116 of the teeth 80 of the stationary blade 22 (shown in FIG. 5). In the state as shown in FIG. 6, the comb piece 32 is shown in an at least partially extended state with respect to the stationary blade 22. Hence, in terms of the movement direction 40, the tips 108 of the teeth 36 of the comb piece 32 are, in the frontal direction, protruding beyond the tips 116 of the teeth 80 of the stationary blade 22. In other words, the tips 116 of the stationary blade 22 are rearwardly offset from the tips 108 of the teeth 36 of the comb piece 32.

Figure 7:
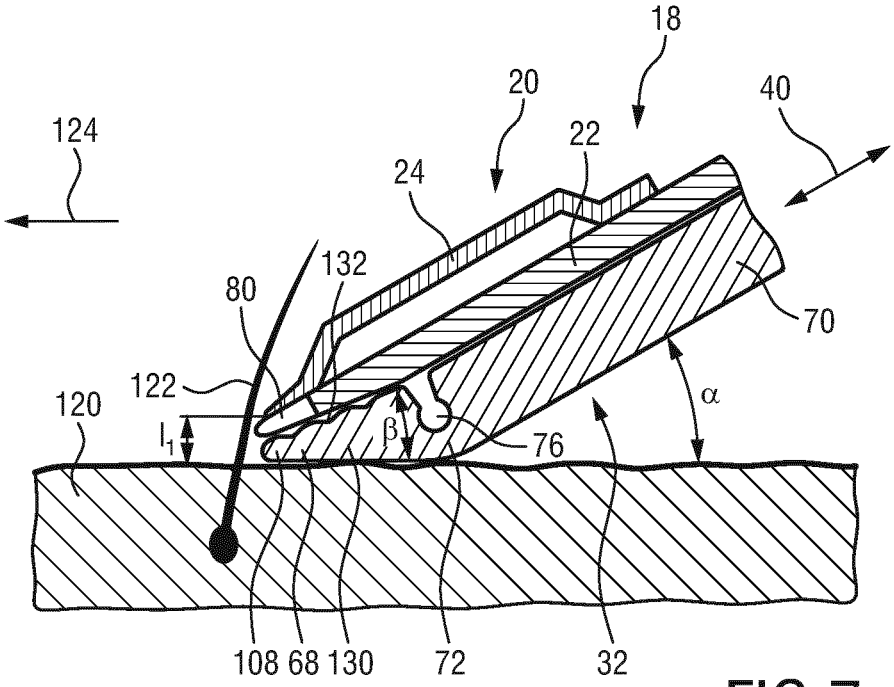
FIG. 7 is a partial simplified lateral view of a blade set that is equipped with a comb piece, in a first state of operation.
Figure 8:
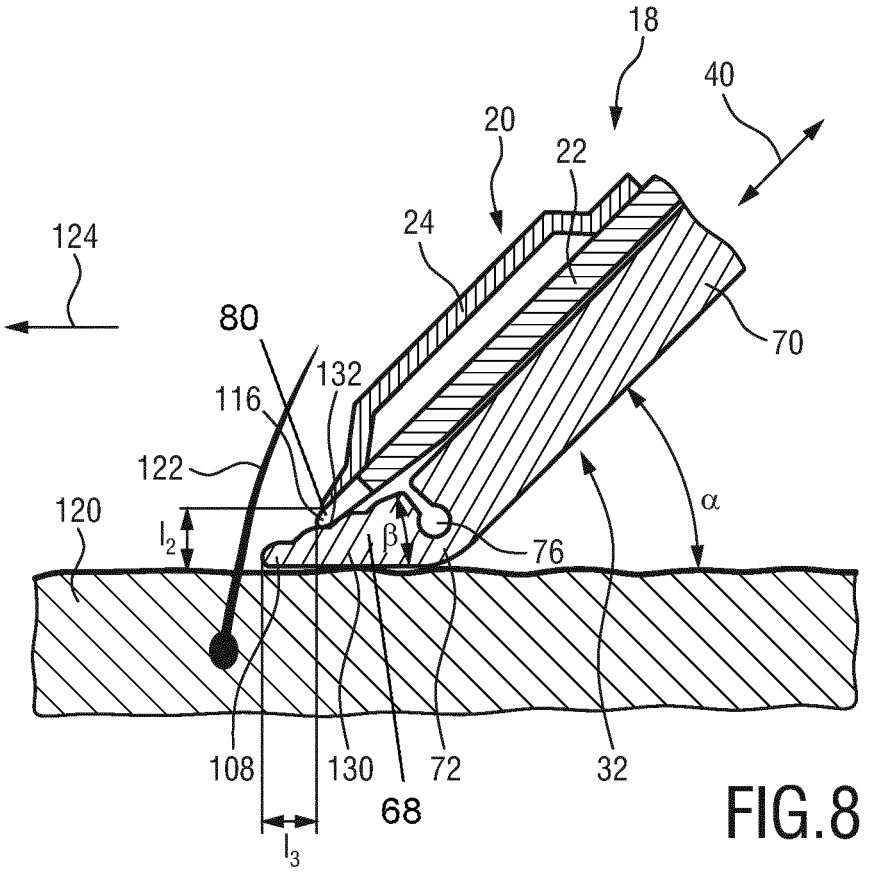
FIG. 8 is a further view of the arrangement of FIG. 7, in a second state of operation.

Further reference is made to FIG. 7 and FIG. 8. Therein, schematic partial illustrations of a blade set 20 to which a comb piece 32 is coupled are provided. In FIG. 7, the comb piece 32 is arranged in a retracted position. In FIG. 8, the comb piece 32 is arranged in an at least somewhat extended position with respect to the blade set 20. The respective adjustment movement direction is indicated in FIG. 7 and FIG. 8 by 40.

In FIG. 7, a resulting cutting length is indicated by I1. In FIG. 8, a resulting cutting length is indicated by I2. The cutting length $I_1$ in the retracted state of the comb piece 32 is smaller than the cutting length $I_2$ in the partially extended state of the comb piece 32. Further, in FIG. 8, a protrusion length of the comb piece 32 with respect to the tips 116 of the stationary blade 22 is indicated by $I_3$. In FIG. 7, no respective protrusion is present in the fully retracted state.

Further, both in FIG. 7 and FIG. 8, the cutting head 18 contacts a skin portion 120 to cut a hair 122 that is growing at the skin 120. An overall movement or advancing direction is indicated in FIG. 7 and FIG. 8 by 124. As with the embodiments discussed further above, also the comb piece 32 of FIGS. 7 and 8 comprises a rear portion 70, a frontal portion 68, and a flexure section 72 formed therebetween.

At the comb piece 32, an inherent bias or tension is present that urges the frontal portion 68 against the stationary blade 22, particularly against the teeth 80 thereof. Depending on the relative adjustment position of the comb piece 32 with respect to the blade set 20, the frontal portion 68 may be at least slightly tilted or swiveled about an axis that is defined by the flexure section 72.

The frontal portion 68 is, seen in lateral view, tapered towards the tips 108. In other words, the frontal portion 68 comprises a wedge-shaped design. An angle of the tapering 130 is indicated in FIG. 7 and FIG. 8 by β (beta). An overall working angle of the cutting head 18 and, consequently, the blade set 20, with respect to the skin 120 is indicated in FIG. 7 and FIG. 8 by α (alpha). Due to the tapered design of the frontal portion 68 of the comb piece 32, the working angle α varies depending on the actual adjustment position of the comb piece 32 with respect to the stationary blade 22.

In one exemplary embodiment, in order to keep the dimensions I2 and I3 (FIG. 8) at approximately the same level, the angle β may be set to a value between 20° and 60° (degrees). Further, in an exemplary embodiment the length setting increment (step size) in the adjustment movement direction 40 may be in a range between 0.5 mm to 3.0 mm. These measures have the benefit that the trimmed hair length may remain basically the same, regardless of an actual orientation of the comb piece 32 with respect to the skin 120, particularly regardless of an actual angle a between the cutting head 18 (to which the comb piece 32 is attached) and the skin 120. Generally, it may be advantageous to design the adjustment mechanism such that the dimensions I2 and I3 are the same or at least basically similar, regardless of the actual length setting of the spacing comb arrangement 30.

A top surface of the frontal portion 68, provided at a skin-facing side thereof, contacts the skin 120 in the operation states shown in FIG. 7 and FIG. 8. Further, as already illustrated in FIG. 5, also at the stationary blade 22, a respective frontal tapering (inclined frontal portion 94) may be provided. This has the effect that, as the comb piece 32 is further extended in the adjustment movement direction 40, more room for the tilting or swiveling movement of the frontal portion 68, due to the inherent biasing/tensioning force, is present. Hence, in the state shown in FIG. 8, where the comb piece 32 is further advanced than in the state shown in FIG. 7, the frontal portion 68 is further deflected with respect to the rear portion 70.

Figure 9:
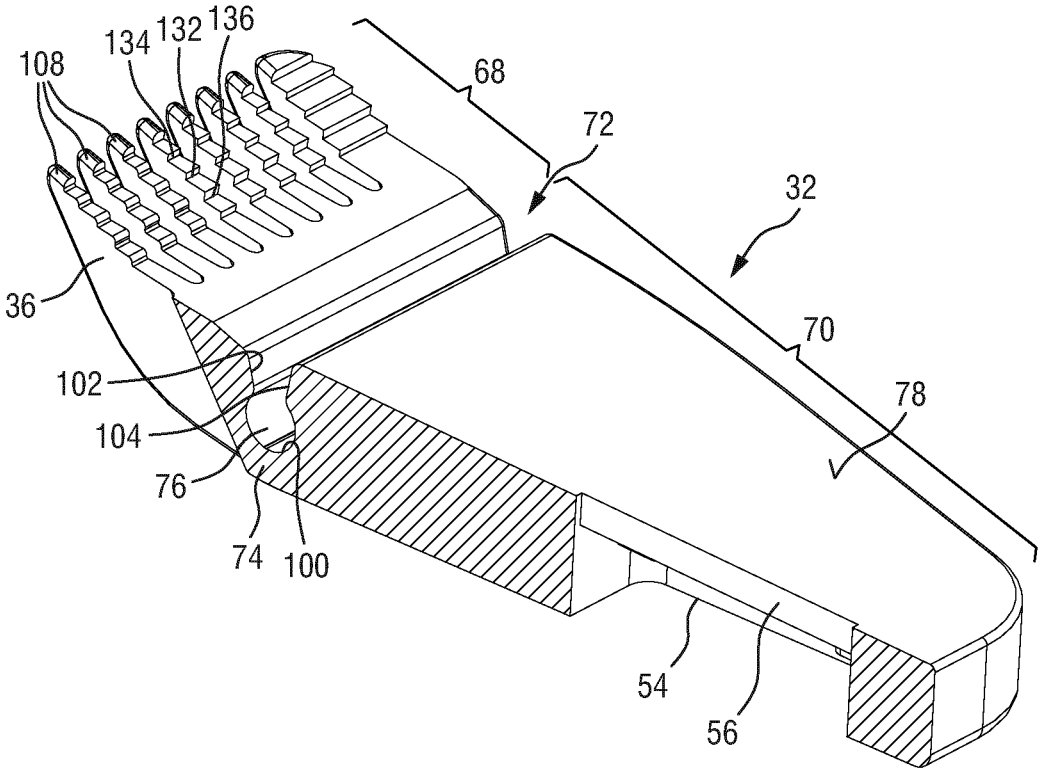
FIG. 9 is a perspective cross-sectional rear view of a comb piece having a flexure section.

As already indicated in FIG. 7 and FIG. 8, the side of the frontal portion 68 of the comb piece 32 that is facing away from the skin 120 may be provided with at least one indentation, notch, or, more generally, depression 132. In this connection, further reference is made to the cross-sectional perspective view of FIG. 9. In FIG. 9, a bottom side of the comb piece 32 is shown from a rear perspective. At the bottom side of the comb piece 32, the contact surface 78 is present that contacts the skin-facing side 26 (FIG. 5) of the stationary blade 22 when the comb piece 32 is mounted thereto. As already explained further above, the comb piece 32 comprises a frontal portion 68 and a rear portion 70, wherein a flexure section 72 is provided therebetween. In the embodiment shown in FIG. 9, a living hinge 74 is formed in the flexure section 72, wherein the living hinge 74 is defined by a reduced wall thickness, as an indentation 76 extends laterally through the comb piece 32. Further, the groove base 100, the frontal flank 102 and the rear flank 104 of the indentation 76 are indicated in FIG. 9.

In the frontal portion 68, a plurality of comb teeth 36 is provided. At the comb teeth 36, a plurality of depressions 132, 134, 136 is formed, extending laterally through the teeth 36. At least in a considerably extended state of the comb piece 32 (refer to FIG. 8), the tips 116 of the teeth 80 of the stationary blade 22 respectively engage one of the depressions 132, 134, 136. Hence, in at least some embodiments, the position of the depressions 132, 134, 136 is adapted to a respective set of adjustment positions of the comb piece 32 with respect to the stationary blade.

As shown in FIG. 8, the teeth 80 of the stationary blade 22 may at least partially dip in the depressions 132, 134, 136 in the respective relative position between the comb piece 32 and the stationary blade 22. This measure has the effect that bulges between the depressions 132, 134, 136 may somewhat cover a frontal end of the tips 116 of the teeth 80. Hence, the likelihood of hairs 122 entering a frontal gap between the skin-facing side of the stationary blade 22 and the opposite contact side of the comb piece 32 may be greatly reduced. Hence, the risk of pulled hairs or ripped off hairs may be reduced. Further, the hair catching capability is generally improved by this measure. In FIG. 9, the depressions 132, 134, 136 form a somewhat stepped shape of the teeth 36. Hence, in other words, in FIG. 8 the depressions 132, 134, 136 are notches, particularly wedge-shaped notches.

Figure 10:
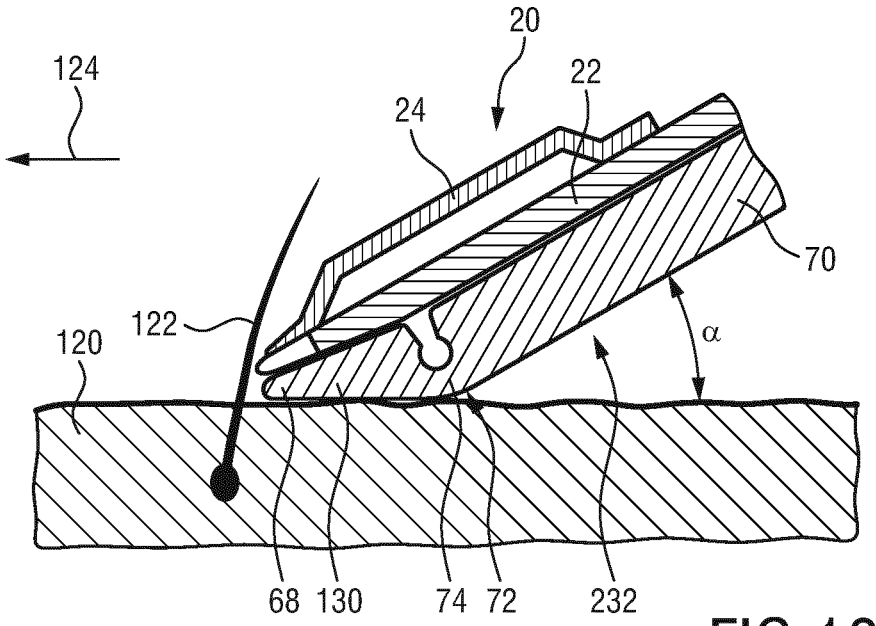
FIG. 10 is a partial, simplified lateral view of a blade set that is equipped with a further embodiment of a comb piece.

Further reference is made to FIG. 10 illustrating a comb piece 232 that is basically similar to the arrangement shown in FIG. 7. In contrast to the embodiment illustrated in FIG. 7 and FIG. 8, the comb piece 232 of FIG. 10 is not provided with respective depressions 132, 134, 136. In the comb piece 232, the flexure section 72 comprises a living hinge 74, as already discussed herein before. Consequently, the frontal portion 68, where the tapering 130 is provided, may be tilted with respect to the rear portion 70. Due to an inherent biasing or bending force, the frontal portion 68 is urged against the stationary blade 22.

Figure 11:
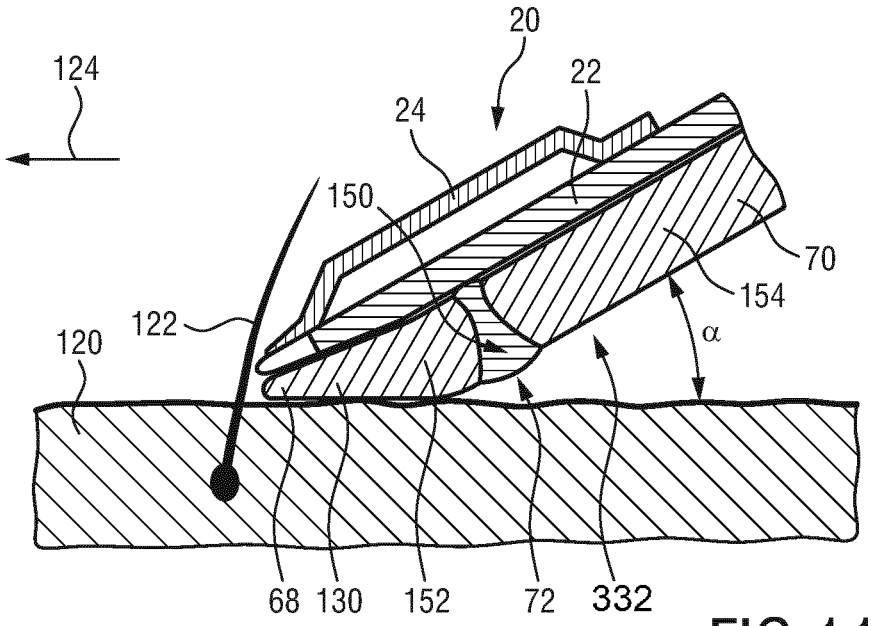
FIG. 11 is a further partial, simplified lateral view of a blade set that is equipped with a further embodiment of a comb piece.

Similarly, FIG. 11 illustrates a comb piece 332 that is attached to a blade set 20. As with the comb pieces 32, 232 described herein before, also the comb piece 332 comprises a frontal portion 68 and a rear portion 70, wherein a flexure section 72 is formed therebetween to provide for a tilting or swiveling movement between the frontal portion 68 and the rear portion 70. Hence, the frontal portion may be urged by an inherent bias/tensioning force against the stationary blade 22.

Generally, the comb pieces 32, 232 discussed further above, are integrally shaped in one piece. By contrast, the comb piece 232 is a multi-component part. In the exemplary arrangement of FIG. 11, the flexure section 72 is formed by a soft component 150. The frontal portion 68 is formed by a hard component 152. The rear portion 70 is formed by a hard component 154. Hence, the soft component 150 forms a hinge or pivot between the frontal portion 68 and the rear portion 70.

In some respect, also the comb piece 332 may be arranged as an integrally formed or integrally molded part. It is conceivable to form the comb piece 332 as a multi-component injecting molding part. This involves that the comb piece 332 is, so to say, already assembled in the molding procedure as the soft component 150 and the hard component 152, 154 are bonded to one another.

As indicated above, in some exemplary embodiments, the frontal portion 68 is, at least in part, moved in response to external forces applied to the appliance 10. Assuming that in a non-engaged state of the appliance 10, a gap is present between the frontal portion 68 of the comb piece 32, 232, 332, the gap may be closed due to the press-on force applied on the housing 12 when the appliance 10 is operated and pushed against the skin.

While the invention has been illustrated and described in detail in the drawings and foregoing description, such illustration and description are to be considered illustrative or exemplary and not restrictive; the invention is not limited to the disclosed embodiments. Other variations to the disclosed embodiments can be understood and effected by those skilled in the art in practicing the claimed invention, from a study of the drawings, the disclosure, and the appended claims.

In the claims, the word "comprising" does not exclude other elements or steps, and the indefinite article "a" or "an" does not exclude a plurality. A single element or other unit may fulfill the functions of several items recited in the claims. The mere fact that certain measures are recited in mutually different dependent claims does not indicate that a combination of these measures cannot be used to advantage.

Any reference signs in the claims should not be construed as limiting the scope.

It follows a list of further embodiments and arrangements within the context of the present disclosure that are specified in the following clauses:

Clause 1:

A spacing comb arrangement (30) for a hair cutting appliance (10), the comb arrangement (30) comprising a comb piece (32, 232, 332) that is arranged to be disposed at a skin-facing side (26) of a stationary blade (22) of a blade set (20), the comb piece (32, 232, 332) comprising:

a plurality of comb teeth (36) that define a cutting length of the blade set (20) when the comb arrangement (30) is mounted, and a flexure section (72) that is arranged to urge a frontal portion (68) of the comb piece (32, 232, 332) against the skin-facing side (26) of the stationary blade (22).

Clause 2:

A spacing comb arrangement (30) for a hair cutting appliance (10), in particular according to clause 1, the comb arrangement (30) comprising a comb piece (32, 232, 332) that is arranged to be disposed at a skin-facing side (26) of a stationary blade (22) of a blade set (20), the comb piece (32, 232, 332) comprising:

a plurality of comb teeth (36) that define a cutting length of the blade set (20) when the comb arrangement (30) is mounted, a frontal portion (68) that is arranged to be urged against the skin-facing side (26) of the stationary blade (22), and a flexure section (72) that provides the comb piece (32, 232, 332) with an increased deformability for the movement of the frontal portion (68).

Clause 3:

The comb arrangement (30) according to clause 1 or 2, wherein the flexure section (72) is integrated in the comb piece (32, 232, 323).

Clause 4:

The comb arrangement (30) according to any of clauses 1 to 3, wherein at least one living hinge (74) is formed between the frontal portion (68) and a rear portion (70) of the comb piece (32, 232).

Clause 5:

The comb arrangement (30) according to any of clauses 1 to 4, wherein the comb arrangement (30) is adjustable, wherein the comb piece (32, 232, 332) is movable with respect to the stationary blade (22) between a retracted state and an extended state.

Clause 6:

The comb arrangement (30) according to any of clauses 1 to 5, wherein an inherent warpage of the comb piece (32, 232, 332) urges the frontal portion (68) thereof towards the stationary blade (22).

Clause 7:

The comb arrangement (30) according to any of clauses 1 to 6, wherein the comb piece (32, 232, 332) is shaped in such a way that the frontal portion (68) thereof is urged against the stationary blade (22) when a rear portion (70) thereof is mounted to the appliance (10).

Clause 8:

The comb arrangement (30) according to any of clauses 1 to 7, wherein the comb piece (32, 232) is integrally shaped.

Clause 9:

The comb arrangement (30) according to any of clauses 1 to 7, wherein the comb piece (32) is a multi-component integrally formed part, wherein a soft component (150) and at least one hard component (152, 154) are provided that are bonded to one another.

Clause 10:

The comb arrangement (30) according to any of clauses 1 to 9, wherein in the comb piece (32, 232, 332) an indentation (76) is formed that increases the flexibility of the comb piece (32, 232, 332), wherein the indentation (76) preferably forms a limit stop for a bending movement between the frontal portion (68) and the rear portion (70) of the comb piece (32, 232, 332).

Clause 11:

The comb arrangement (30) according to any of clauses 1 to 10, wherein at the frontal portion (68) of the comb piece (32, 232, 332) at least one depression (132, 134, 136) is provided, the depression (132, 134, 136) extending parallel to a leading edge of the stationary blade (22), and wherein frontal tips (116) of stationary blade teeth (80) at least partially dip in the depression (132, 134, 136) when the comb piece (32, 232, 332) and the stationary blade (22) are in a defined relative longitudinal position.

Clause 12:

The comb arrangement (30) according to clause 11, wherein a plurality of depressions (132, 134, 136) is provided that are basically parallel to one another, and wherein the arrangement of the depressions (132, 134, 136) is adapted to respective length adjustment positions of the comb piece (32, 232, 332) in relation to the stationary blade (22).

Clause 13:

A cutting head (18) for a hair cutting appliance (10), comprising a blade set (20) including a movable blade (24) and a stationary blade (22) that are arranged to be moved with respect to one another to cut hair trapped therebetween, the cutting head (18) comprising a comb arrangement (30) according to any of the preceding clauses.

Clause 14:

The cutting head (18) according to clause 13, wherein the stationary blade (22), at a skin-facing side (26) thereof, comprises a basically planar rear portion (96) and an inclined frontal portion (94), and wherein the frontal portion (68) of the comb piece (32, 232, 332) is urged against the frontal portion (94) of the stationary blade (22).

Clause 15:

A hair cutting appliance (10), particularly an electrically powered hair trimmer, the appliance (10) being arranged to be moved through hair to cut hair and comprising a housing (12), a cutting head (18), and a comb arrangement (30) according to any of the clauses 1 to 12 that is arranged to be attached to the cutting head (12).

The invention claimed is:

1. A spacing comb arrangement for a hair cutting appliance, the comb arrangement comprising:

a comb piece that is arranged to be disposed at a skin-facing side of a stationary blade of a blade set, the comb piece comprising:

a frontal portion, a plurality of comb teeth, formed at the frontal portion, that defines a cutting length of the blade set when the comb arrangement is mounted, a rear portion arranged to be attached to the hair cutting appliance, and a flexure section arranged between the frontal portion and the rear portion, the flexure section being arranged to urge the frontal portion against the skin-facing side of the stationary blade, when the appliance is operated, wherein the flexure section defines a deflection axis between the frontal portion and the rear portion, wherein the flexure section is integrated in the comb piece, wherein a directional bias on the frontal portion is present when the comb piece is attached to the hair cutting appliance, and wherein the comb piece is an integrally shaped comb piece being one piece including the frontal portion having the plurality of comb teeth, the rear portion attachable to the hair cutting appliance and the flexure section, and wherein at the frontal portion of the comb piece at least one depression is provided, the depression extending parallel to a leading edge of the stationary blade and arranged to be engaged by frontal tips of stationary blade teeth of the stationary blade when the comb piece and the stationary blade are in a defined relative longitudinal position.

2. The comb arrangement as claimed in claim 1, wherein the flexure section provides the comb piece with an increased deformability for the movement of the frontal portion.

3. The comb arrangement as claimed in 1, wherein, when the comb piece is attached to the hair cutting appliance, the frontal portion and the rear portion are twisted or tilted away from one another about an axis defined by the flexure section to generate a respective counterforce that urges the frontal portion against and into contact with the stationary blade.

4. The comb arrangement as claimed in claim 1, wherein at least one living hinge is formed between the frontal portion and a rear portion of the comb piece.

5. The comb arrangement as claimed in claim 1, wherein the comb arrangement is adjustable, wherein the comb piece is movable with respect to the stationary blade between a retracted state and an extended state.

6. The comb arrangement as claimed in claim 1, wherein an inherent warpage of the comb piece urges the frontal portion thereof towards the stationary blade.

7. The comb arrangement as claimed in claim 1, wherein the comb piece is shaped in such a way that the frontal portion thereof is urged against the stationary blade when a rear portion thereof is mounted to the appliance.

8. The comb arrangement as claimed in claim 1, wherein the frontal portion and the rear portion are harder material than a material of the flexure section.

9. The comb arrangement as claimed in claim 1, wherein in the comb piece an indentation is formed that increases the flexibility of the comb piece, wherein the indentation forms a limit stop for a bending movement between the frontal portion and the rear portion of the comb piece.

10. The comb arrangement as claimed in claim 1, wherein the at least one depression includes depressions that are parallel to one another, and wherein an arrangement of the depressions is adapted to respective length adjustment positions of the comb piece in relation to the stationary blade.

11. A cutting head for a hair cutting appliance, comprising a blade set including a movable blade and a stationary blade that are arranged to be moved with respect to one another to cut hair trapped therebetween, the cutting head comprising a comb arrangement, wherein the comb arrangement comprises:

a comb piece that is arranged to be disposed at a skin-facing side of the stationary blade of the blade set, the comb piece comprising:

a frontal portion, a plurality of comb teeth, formed at the frontal portion, that defines a cutting length of the blade set when the comb arrangement is mounted, a rear portion arranged to be attached to the hair cutting appliance, and a flexure section arranged between the frontal portion and the rear portion, the flexure section being arranged to urge the frontal portion against the skin-facing side of the stationary blade, when the appliance is operated, wherein the flexure section defines a deflection axis between the frontal portion and the rear portion, wherein the flexure section is integrated in the comb piece, wherein a directional bias on the frontal portion is present when the comb piece is attached to the hair cutting appliance, wherein the comb piece is an integrally shaped comb piece being one piece including the frontal portion having the plurality of comb teeth, the rear portion attachable to the hair cutting appliance and the flexure section, and wherein the frontal portion and the rear portion are harder material than a material of the flexure section.

12. The cutting head as claimed in claim 11, wherein the stationary blade, at a skin-facing side thereof, comprises a basically planar rear portion and an inclined frontal portion, and wherein the frontal portion of the comb piece is urged against the frontal portion of the stationary blade.

13. The cutting head claim 11, wherein the comb piece includes an indentation that increases flexibility of the comb piece, wherein the indentation forms a limit stop for a bending movement between the frontal portion and the rear portion of the comb piece.

14. The cutting head claim 11, wherein the frontal portion of the comb piece includes at least one depression, the depression extending parallel to a leading edge of the stationary blade and configured to be engaged by frontal tips of stationary blade teeth of the stationary blade when the comb piece and the stationary blade are in a defined relative longitudinal position.

15. The cutting head claim 11, wherein the frontal portion includes depressions that are parallel to one another, and wherein an arrangement of the depressions is adapted to respective length adjustment positions of the comb piece in relation to the stationary blade.

16. A hair cutting appliance, the appliance being arranged to be moved through hair to cut the hair and comprising a housing, a cutting head, and a comb arrangement configured to be attached to the cutting head, wherein the comb arrangement comprises:

a comb piece that is arranged to be disposed at a skin-facing side of a stationary blade of a blade set, the comb piece comprising:

a frontal portion, a plurality of comb teeth, formed at the frontal portion, that defines a cutting length of the blade set when the comb arrangement is mounted, a rear portion arranged to be attached to the hair cutting appliance, and a flexure section arranged between the frontal portion and the rear portion, the flexure section being arranged to urge the frontal portion against the skin-facing side of the stationary blade, when the appliance is operated, wherein the flexure section defines a deflection axis between the frontal portion and the rear portion, wherein the flexure section is integrated in the comb piece, wherein a directional bias on the frontal portion is present when the comb piece is attached to the hair cutting appliance, wherein the comb piece is an integrally shaped comb piece being one piece including the frontal portion having the plurality of comb teeth, the rear portion attachable to the hair cutting appliance and the flexure section, and wherein the frontal portion of the comb piece includes at least one depression, the depression extending parallel to a leading edge of the stationary blade and configured to be engaged by frontal tips of stationary blade teeth of the stationary blade when the comb piece and the stationary blade are in a defined relative longitudinal position.

17. The hair cutting appliance claim 16, wherein the at least one depression includes depressions that are parallel to one another, and wherein an arrangement of the depressions is adapted to respective length adjustment positions of the comb piece in relation to the stationary blade.

18. A spacing comb arrangement for a hair cutting appliance, the comb arrangement comprising:

a comb piece that is arranged to be disposed at a skin-facing side of a stationary blade of a blade set, the comb piece comprising:

a frontal portion, a plurality of comb teeth, formed at the frontal portion, that defines a cutting length of the blade set when the comb arrangement is mounted, a rear portion arranged to be attached to the hair cutting appliance, and a flexure section arranged between the frontal portion and the rear portion, the flexure section being arranged to urge the frontal portion against the skin-facing side of the stationary blade, when the appliance is operated, wherein the flexure section defines a deflection axis between the frontal portion and the rear portion, wherein the flexure section is integrated in the comb piece, wherein a directional bias on the frontal portion is present when the comb piece is attached to the hair cutting appliance, and wherein the comb piece is an integrally shaped comb piece being one piece including the frontal portion having the plurality of comb teeth, the rear portion attachable to the hair cutting appliance and the flexure section, and wherein the frontal portion and the rear portion are harder material than a material of the flexure section.

* * * * *